US009841151B2

(12) United States Patent
Ishibashi

(10) Patent No.: US 9,841,151 B2
(45) Date of Patent: Dec. 12, 2017

(54) BELT-LIKE LED LIGHT

(71) Applicant: ATEX CO., LTD., Fukuoka (JP)

(72) Inventor: Kazuo Ishibashi, Fukuoka (JP)

(73) Assignee: ATEX CO., LTD., Fukuoka (JP)

( * ) Notice: Subject to any disclaimer, the term of this patent is extended or adjusted under 35 U.S.C. 154(b) by 36 days.

(21) Appl. No.: 14/864,280

(22) Filed: Sep. 24, 2015

(65) Prior Publication Data

US 2016/0281969 A1 Sep. 29, 2016

(30) Foreign Application Priority Data

Mar. 26, 2015 (JP) ..... 2015-064788

(51) Int. Cl.

| | |
|---|---|
| ***F21V 21/32*** | (2006.01) |
| ***F21V 3/00*** | (2015.01) |
| ***F21S 4/22*** | (2016.01) |
| ***F21V 3/04*** | (2006.01) |
| *F21V 31/04* | (2006.01) |
| *F21V 23/02* | (2006.01) |
| *F21Y 103/10* | (2016.01) |
| *F21Y 115/10* | (2016.01) |

(52) U.S. Cl.

CPC ..... *F21S 4/22* (2016.01); *F21V 3/0463* (2013.01); *F21V 23/02* (2013.01); *F21V 31/04* (2013.01); *F21Y 2103/10* (2016.08); *F21Y 2115/10* (2016.08)

(58) Field of Classification Search

CPC ..... F21V 15/01; F21V 15/012; F21V 21/32; F21V 3/00; F21V 3/001; F21S 4/20; F21S 4/22

See application file for complete search history.

(56) References Cited

U.S. PATENT DOCUMENTS 5,452,187 A * 9/1995 Belfer ..... F21V 21/32 362/221
7,377,787 B1 5/2008 Eriksson
(Continued)

FOREIGN PATENT DOCUMENTS

JP 9-297549 A 11/1997
JP 3098840 U 3/2004
(Continued)

*Primary Examiner* — Karabi Guharay
(74) *Attorney, Agent, or Firm* — Nakanishi IP Associates, LLC

(57) ABSTRACT

A belt-like LED light includes an LED unit with a plurality of LEDs, a belt-like insulating case having a space and a partition plate, and a light-diffusing portion. The LED unit is inserted into the space of the belt-like insulating case, such that at least a part of the light transmits through the partition plate. The light-diffusing portion is continuously installed outside of the belt-like insulating case. The light-diffusing portion includes an open space and a curved section surrounding the open space. The curved section is made of light-diffusive material and diffusing the light having transmitted through the partition plate and the open space. The LEDs of the LED unit are connected with the electric wires for light-emitting. The LED unit is formed capable of being folded standing laterally against the light-emitting direction. The belt-like insulating case and the light-diffusing portion are made of flexible material.

2 Claims, 11 Drawing Sheets

(56) References Cited

U.S. PATENT DOCUMENTS

| | | | | |
|---|---|---|---|---|
| 8,449,140 | B2 * | 5/2013 | Martin | F21V 3/04 362/217.02 |
| 8,979,307 | B2 | 3/2015 | Ishibashi et al. | |
| 2005/0173708 | A1 * | 8/2005 | Suehiro | H01L 33/56 257/79 |
| 2005/0195603 | A1 * | 9/2005 | Hulse | F21S 4/20 362/246 |

FOREIGN PATENT DOCUMENTS

| | | | |
|---|---|---|---|
| JP | 2004-227826 | A | 8/2004 |
| JP | 2004-526185 | A | 8/2004 |
| JP | 3897260 | B2 | 3/2007 |
| JP | 2013-118169 | A | 6/2013 |
| WO | 02/061328 | A1 | 8/2002 |

* cited by examiner

BELT-LIKE LED LIGHT

BACKGROUND OF THE INVENTION

1. Field of the Invention

The present invention relates to a belt-like LED light.

2. Description of the Related Art

Upon turning on a plurality of LEDs (Light-Emitting Diodes) of an SMD (Surface Mount Device) type having been linearly mounted on a circuit substrate, a light-emitting direction is generally a direction perpendicular to the circuit substrate. If the circuit substrate is manufactured using a belt-like FPC (Flexible Printed Circuit) which is easily bent, the light-emitting module itself can be also bent against the light-emitting direction. Such goods have been manufactured and commercially available as "tape lights."

According to this structure, unless the belt-like light-emitting module is twisted, it is difficult to bend the module in a direction (lateral direction of the belt-like FPC) perpendicular to the light-emitting direction of the LEDs. The FPC must have width no less than 7 millimeters in order to mount parts thereon to form a circuit. So, the module cannot be bent in the lateral direction.

In order to bend the FPC substrate in the lateral direction perpendicular to the light-emitting direction, LEDs of a side emission type or a bullet-type may be used. When the side emission type LEDs are used, since the light-emitting direction of the LEDs is the width direction of the substrate, the belt-like substrate of the FPC can be bent in the lateral direction perpendicular to the light-emitting direction. This is the same as the bullet-type LEDs. Reference 1 (Japanese Unexamined Patent Application Publication (Translation of PCT Application) No. 2004-526185), Reference 2 (Registered Japanese utility model No. 3098840), and Reference 3 (Registered Japanese Patent No. 3897260) disclose examples of flexible light-emitting modules using the bullet-type LEDs.

As an example not using the FPC, Reference 4 (Japanese patent application Laid-open on No. 9-297549) recites a flexible linear light-emitting module configured as follows. That is, two or more pairs of positive and negative feeders are arranged in a spiral or intersected state. A plurality of LEDs and current-limiting resistances are in series connected between the pairs to configure a series circuit. One or more of the series circuits are connected in parallel. And then, the feeders and so on are covered with soft and translucent synthetic resin to configure the flexible linear light-emitting module.

Reference 5 (U.S. Pat. No. 7,377,787) proposes an illumination device, comprising: electrical components (LEDs);

a tabbed circuit substrate on which the LEDs are mounted and operably connected; and a light-diffusing member for receiving light emitted from the LEDs, wherein:

the tabbed circuit substrate includes:

a flexible substrate of a predetermined length;

a conductive trace formed on the flexible substrate; and tabs arranged along a lateral edge of the flexible substrate, one or more of the electrical components are connected to the conductive trace at respective tabs, and the tabs can be bent from a first position in which the tabs are aligned with the remainder of the substrate to a second position in which the tabs are oriented at an angle (90 degrees) relative to the remainder of the substrate.

As mentioned above, even if the LEDs of the surface mounting type have been mounted on the FPC, light is always emitted in the lateral direction perpendicular to the FPC surface. That is, light does not always emit in a shape that the FPC is bent.

Whereas, upon using the LEDs of the side emission or the bullet-type, light is always radiated in a shape that the FPC is bent. Variation in luminance and color of those, however, is so poor that various customer needs cannot be satisfied thereby. This is because the LEDs of the side emission or the bullet-type are not used except for particular application.

Reference 4 discloses the flexible linear light-emitting module not using the FPC. Due to this, a step of mounting LEDs thereon and another step of twisting feeders are needed. So, there are some problems in mass production.

Reference 5 discloses the circuit substrate and the lighting system using the same. Herein, there is a problem that a part of light emitted from the LEDs is blocked by the circuit substrate itself when the LEDs are positioned lower than the circuit substrate. This is because the LEDs are mounted the inside of the tabs having been bent perpendicularly to the circuit substrate.

When the LEDs are mounted outside of the tabs, the whole of the lighting system becomes too high. This is because both of the LEDs and the light-diffusing member must project toward the outside of the tabs.

In Reference 5, the LEDs are mounted at positions shifted from the circuit substrate. When the LEDs are arranged on the center line, the circuit substrate must be shifted from the center line. Accordingly, upon using in a bent state, there is a problem that the circuit substrate must undergo stress.

Furthermore, in order to supply electric current to the LEDs mounted on the tabs, the conductive traces are formed on the circuit substrate. In Reference 5, since on the common circuit substrate, all conductive traces for positive and negative sides are formed, the width of the circuit substrate cannot be narrower than a fixed size. Accordingly, downsizing the circuit substrate is remarkably limited.

In view of the above, in Reference 6 (Japanese patent application Laid-open on No. 2013-118169), the applicant has proposed a belt-like LED light, comprising:

a LED-mounting circuit substrate;

a light-emitting unit; and transparent or translucent flexible insulation material covering the light-emitting unit, the LED-mounting circuit substrate including:

a long belt-like flexible substrate;

a LED-mounting portion that LEDs are mounted in an array state on a center portion in a width direction of the long belt-like flexible substrate; and a first substrate and a second substrate including at least two feeding patterns for feeding electric current to the LEDs, the first substrate and the second substrate being positioned at both sides of the LED-mounting portion in the width direction, wherein:

the light-emitting unit is formed by:

mounting the LEDs and electrical parts on the LED-mounting circuit substrate; and folding at least one of the first substrate and the second substrate against the LED-mounting portion.

LIST OF CITED REFERENCES

Reference 1: Japanese Unexamined Patent Application Publication (Translation of PCT Application) No. 2004-526185

Reference 2: Registered Japanese utility model No. 3098840

Reference 3: Registered Japanese Patent No. 3897260

Reference 4: Japanese patent application Laid-open on No. 9-297549

Reference 5: U.S. Pat. No. 7,377,787

Reference 6: Japanese patent application Laid-open on No. 2013-118169

Reference 6 can propose the belt-like LED light, which can be bent in a direction perpendicular to the light-emitting direction, is long, compact, and waterproof. In addition, the circuit substrate thereof is hardly under stress. The belt-like light source, however, cannot radiate uniform, continuous, and even light. This is because it is configured by merely arranging point sources of LEDs in a linear state.

In an embodiment of Reference 6, a solid and semicircular light-diffusing case is fitted around the cover of the light-emitting unit to diffuse light emitted from LEDs in a longitudinal direction of the LED-mounting circuit substrate, thereby forming a linear light source. According to this structure, there are the following problems.

The thickness of a light-diffusing portion in the light-diffusing case becomes too large. The light emitted from a LED light source in an LED light-emitting portion is attenuated too much. The light radiated from the light-diffusing portion turns into dull yellow or the like in chromaticity, thereby reducing visual lighting effect by half. Luminous intensity also varies according to a viewing angle.

In order to solve these problems, a method of providing a light-diffusing portion on an upper surface of an insulating case in which the light-emitting unit is inserted may be considered.

According to this method, the thickness of the light-diffusing portion must be not less than 5 millimeters in order to attain a strap of even and continuous light. In short, the thickness of the light-diffusing portion becomes too great.

The light emitted from the LEDs is so attenuated that necessary strength of light cannot be obtained. In addition, color of radiated light must be deteriorated from the original color of light emitted from the LEDs.

In view of the above, an object of the preset invention is to provide a belt-like LED light that can maintain color and strength of radiated light from original light emitted from LEDs, and that can radiate even and uniform light.

OBJECTS AND SUMMARY OF THE INVENTION

In order to solve the subject-matter, a belt-like LED light according to the present invention, the belt-like LED light comprises: belt-like LED light, comprising: an LED unit including a plurality of LEDs being linearly arranged at predetermined intervals, the plurality of LEDs emitting light in a light-emitting direction; a belt-like insulating case including a space and a partition plate, the LED unit being inserted into the space, the partition plate being made of light-transmissible material, at least a part of the light transmitting through the partition plate; and a light-diffusing portion continuously installed outside of the belt-like insulating case, the light-diffusing portion including an open space and a curved section surrounding the open space, the curved section being made of light-diffusive material and diffusing the light having transmitted through the partition plate and the open space.

In the present invention, at least a part of the light emitted from the LEDs in the LED unit stored in the belt-like insulating case transmits through the partition plate, is radiated to the open space between the partition plate and the light-diffusing portion, and then is radiated to the light-diffusing portion including the curved section. At the light-diffusing portion, the light is diffused in both of a width direction and in a longitudinal direction of the light-diffusing portion by the light-diffusive material. Suitably selecting the predetermined intervals for arranging the LEDs provides to make the light radiated outside from the light-diffusing portion continuous as not a point light source but a linear light source.

The LEDs in the LED unit may be connected with the electric wires for light-emitting. The LED unit may be formed capable of being folded standing laterally against the light-emitting direction. The belt-like insulating case and the light-diffusing portion may be made of flexible material. This enables to make the structure of the belt-like LED light itself flexible.

The flexible belt-like insulating case includes the partition plate, and the light-diffusing portion, which may be integrally formed by two-color molding. Although the partition plate and the light-diffusing position may be formed with different kinds of material regarding whether or not the light-diffusive material is contained therein, the two-color molding enables to integrally form the partition plate and the light-diffusing portion.

The air gap existing between the space of the belt-like insulating case and the LED unit may be filled with at least one of synthetic resin and synthetic rubber for sealing. All of the air gap along the overall length of the belt-like insulating case may be filled. Alternatively, only a part of the air gap may be filled, the part being near openings at both ends of the belt-like insulating case. When the air gap between the space of the belt-like insulating case and the LED unit has been filled with at least one of synthetic resin and synthetic rubber, the belt-like LED light is furnished with a moisture-proof and waterproof construction, and can be also suitably used outdoors.

The present invention provides a belt-like LED light that can emit beautiful, even, and uniform light near original light emitted by the LEDs with less attenuation there-from.

DETAILED DESCRIPTION OF THE PREFERRED EMBODIMENTS

Figure 1:
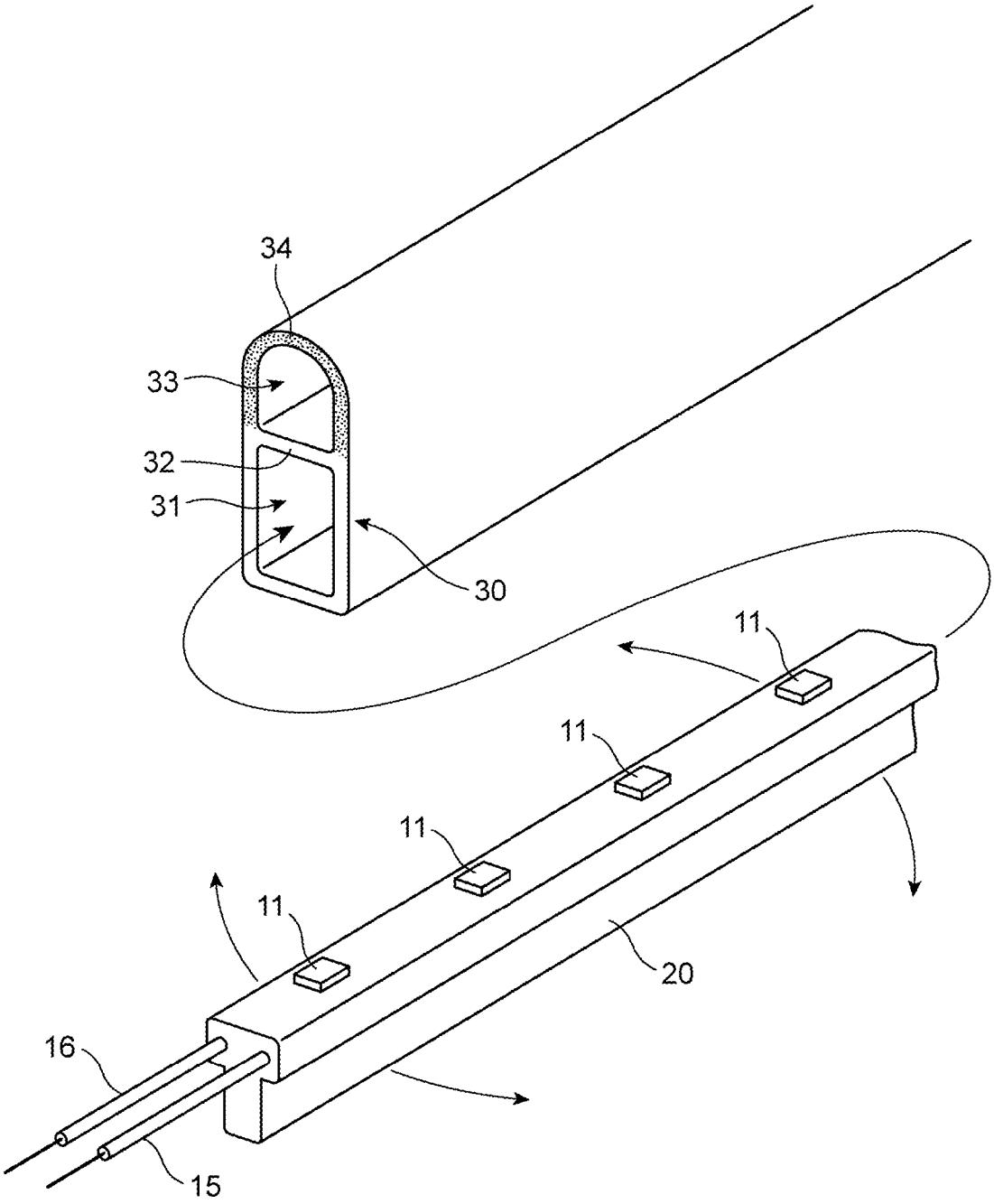
FIG. 1 is a decomposition perspective diagram in Embodiment 1 according to the present invention.

Embodiments of the present invention will now be concretely described with reference to the drawings. FIG. 1 shows a belt-like LED light in Embodiment 1 according to the present invention.

The belt-like LED light includes: an LED unit 20; a belt-like insulating case 30; and a light-diffusing portion 34.

In the LED unit 20, a plurality of LEDs 11 are linearly arranged at predetermined intervals. Each of the LEDs 11 is connected with power-source cable 15 and 16 to emit light. The LED unit 20 is formed capable of being bent in a lateral direction against a light-emitting direction of the LED 11.

The belt-like insulating case 30 includes a space 31 inside thereof, and the LED unit 20 is inserted into the space 31. The belt-like insulating case further includes a partition plate 32 facing in the light-emitting direction. At least a part of light can transmit through the partition plate 32.

The light-diffusing portion 34 is continuously installed outside of the partition plate 32 of the belt-like insulating case 30. The light-diffusing portion 34 is made of light-diffusive material to diffuse light that has transmitted through the partition plate 30 of the belt-like insulating case 30 via an open space 33.

At least a part of the light emitted by the LED 11 transmits the partition plate 32, radiates in the open space 33 within about 180 degrees, and streams into the light-diffusing portion 34.

And then, the light reaches an inside of the light-diffusing portion 34 having a curved and semicircular section, and is diffused thereby.

As a result, even and uniform light is radiated outside from the entire surface of the light-diffusing portion 34.

In this Embodiment, the light-diffusing portion 34 is in a shape of the curved and semicircular section. Alternatively, both sides of an upper portion from a bottom part near the partition plate 32 of the light-diffusing portion 34 may be linearly formed, and then may be smoothly connected to the semicircular section.

In the LED unit 20, each of the LEDs 11 may be directly connected to the power-source cables 15 and 16. Alternatively, each of the LEDs 11 may be mounted on a flexible printing circuit substrate (FPC), and conductive parts thereof are sealed with synthetic resin and/or synthetic rubber to constitute a unit. A unit having a structure capable of being bent in a lateral direction against the light-emitting direction recited in Reference 6 may be used as the LED unit 20.

In a case where the LED unit 20 has the structure capable of being bent, silicone rubber is preferably used as the synthetic rubber for sealing the conductive parts of the LED unit 20. When the belt-like insulating case 30 into which the LED unit 20 is inserted is also made of flexible material, the entire of the belt-like flexible LED light itself can be flexible.

Among parts surrounding the belt-like insulating case 30, the partition plate 32 is light transmissible (transparent or translucent) at least. The light-diffusing portion 34 is made of light-diffusive material formed by mixing light-diffusing agent to at least one of transmissible synthetic resin and transmissible synthetic rubber.

In some cases, all or a part of faces other than the partition plate 32 of the belt-like insulating case 30 may be made of light-diffusive material. For example, in a case of FIG. 2, all other than the partition plate 32 of the belt-like insulating case 30 is made of the light-diffusive material.

Figure 3:
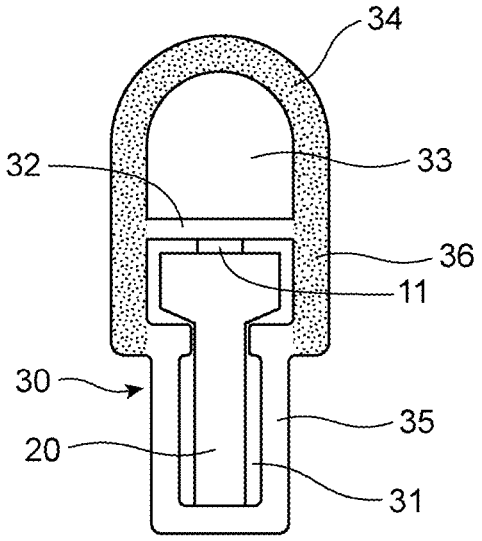
FIG. 3 is a sectional view in another example of integrally forming the insulating case and the light-diffusing portion in Embodiment 1 according to the present invention.

In a case of FIG. 3, the partition plate 32 and a lower part 35 are made of at least one of the transmissible synthetic resin and the transmissible synthetic rubber, and the remainder thereof is made of light-diffusive material.

In order to save the cost for forming process, two-color molding, which is generally used, is employed for forming the belt-like insulating case 30.

Pouring two kinds of material of at least one of the transmissible synthetic resin and the transmissible synthetic rubber and the light-diffusive material with the light-diffusive agent into a metal mold built into a two-color molding machine enables to integrally form the belt-like insulating case 30 equipped with the light-diffusing portion 34.

Although inorganic and cheap particles of infinite forms, such as silica calcium carbonate and barium sulfate, may be used as the light-diffusive agent, it is more preferable to use silicone and/or acrylics particulates of a micro size that suppress reflection of incident light.

The transmissible synthetic resin and the transmissible synthetic rubber can be selected from a group consisting of commercially available material. Polyether resin is preferable as the transmissible synthetic resin, and silicone rubber is also preferable as the transmissible synthetic rubber, for example.

Figure 4:
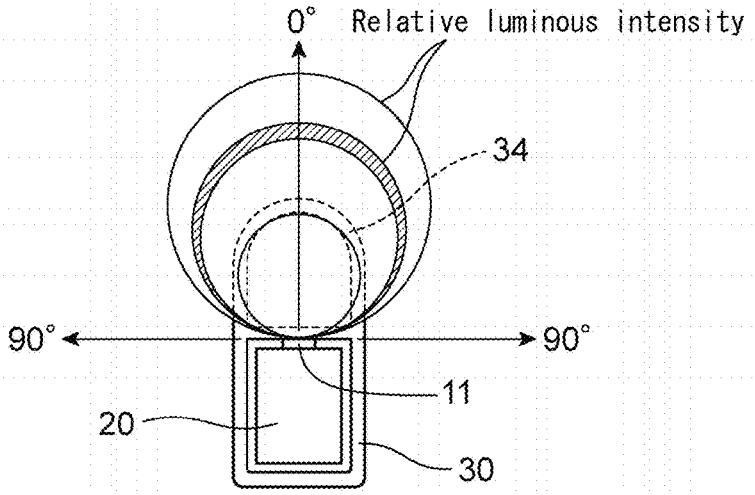
FIG. 4 is a chart illustrating directional characteristics of an LED in the present invention.

FIG. 4 is a chart illustrating relative light intensity of an LED in Embodiment 1 according to the present invention. The relative light intensity characteristics in a width direction of the LED 11 are shown using almost circular contour lines contacting with a light-emitting surface of the LED 11. Bottom points of the contour lines touch the surface of the LED 11.

When a curvature and a position of a semicircle of the light-diffusing portion 34 are set up in a manner such that a lower surface of the light-diffusing portion 34 inscribes with one of the contour lines, luminance of light out of the light-diffusing portion 34 becomes uniform in the width direction.

Figure 5A:
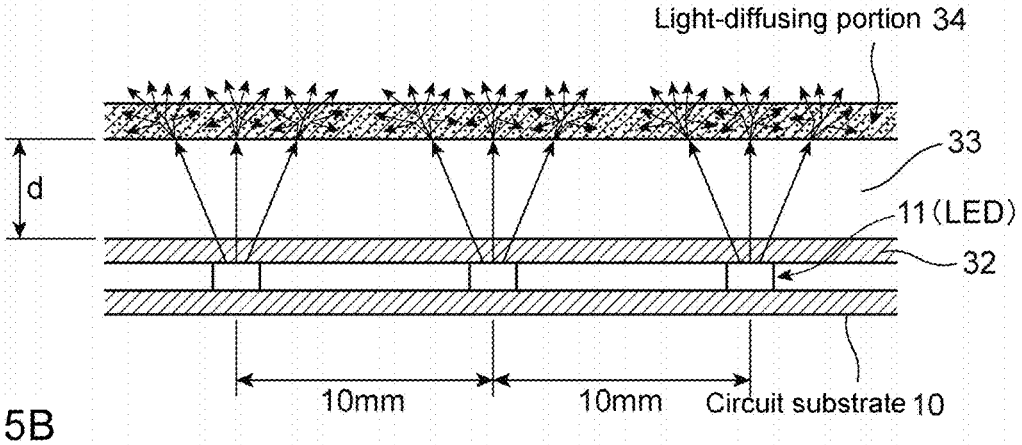
FIG. 5A is a sectional view of the light-diffusing portion and a circuit substrate that configure a linear light source.
Figure 5B:
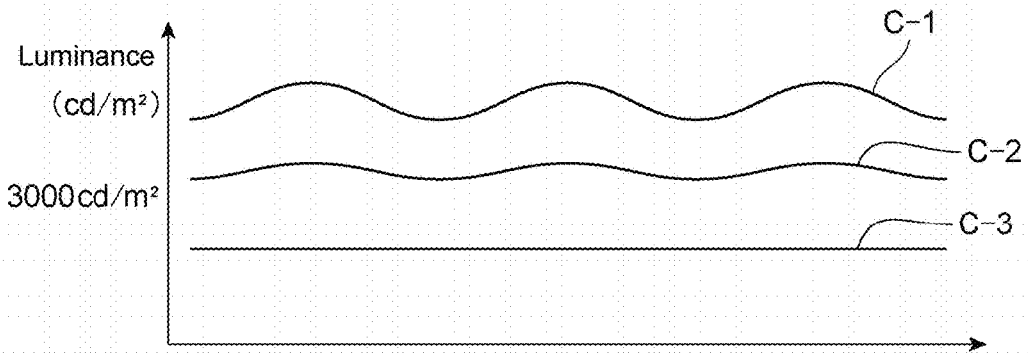
FIG. 5B is a graph showing luminance characteristics according to the present invention.

FIGS. 5A and 5B illustrate a linear light source configured using a plurality of LEDs and the light-diffusing portion according to the present invention. As shown in FIG. 5A, the about 0.3 Watts LEDs 11 of an SMD type are arranged at intervals of about 10 millimeters on a circuit substrate 10. The LEDs 11 emit light at 50 to 120 milli-Watts.

The partition plate 32 exists between the LEDs 11 and the open space 33, and the light-diffusing portion 34 is, next to the open space 33, located at a position of a distance d in a vertical direction away from the partition plate 32.

The thickness of the light-diffusing portion 34 is preferably one millimeter to five millimeters, and more preferably two millimeters to three millimeters. Under this condition, light emitted by the LEDs 11 goes straight into the light-diffusing portion 34, and then is diffused thereby. The light radiated from the light-diffusing portion 34 is recognized as soft and diffused light by human eyes.

When the thickness is less than one millimeter, light diffusing effect of the light-diffusing portion decreases. Whereas, when the thickness is not less than five millimeters, The light transmitted through the light-diffusing portion 34 turns into dull yellow or the like in chromaticity, and attenuation of the light increases.

In general, luminance distribution of light emitted by the simple LED 11 is like Gaussian distribution around an optical axis of the LED 11.

In luminance distribution of light out of the light-diffusing portion 34, foot parts of Gaussian distribution of the LEDs 11 are overlapped in a horizontal direction so that the overlapped foot parts are added with each other to be lifted as indicated using a symbol of "C-2" in FIG. 5B, thereby the luminance distribution of light becomes almost even in total.

Since the luminance distribution changes in accordance with the distance d of the open space 33 between the light-diffusing portion 34 and the partition plate 32, it is necessary to suitably set up the distance d in order to make the luminance distribution even.

When the distance d is too small, light emitted by the LEDs strongly comes out of the light-diffusing portion 34 in a state of spots, and the luminance value thereof is kept high. The luminance distribution, however, remarkably varies in the horizontal direction as indicated using a symbol of "C-1" in FIG. 5B, and a commodity value as an LED light is reduced by half.

On the contrary, when the distance d is too large, luminance distribution in the horizontal direction becomes uniform as indicated using a symbol of "C-3" in FIG. 5B.

The luminance value out of the light-diffusing portion 34, however, cannot reach the necessary luminance value of 3000 [cd/m$^2$] as a lighting system.

The distance d should be preferably set up to 5 to 15 millimeters, more preferably to 5 to 9 millimeters. And then, the luminance value out of the light-diffusing portion 34 can reach the necessary luminance value of 3000 [cd/m$^2$] or more.

At the same time, the luminance distribution in the horizontal direction slightly varies as indicated using a symbol of "C-2" in FIG. 5B, unevenness thereof can be controlled to be small such that human eyes do not mind it.

A lower surface of the partition plate 32 and an upper face of the LEDs 11 are positioned such that these surfaces contact with each other. The distance from the LEDs 11 to a lower surface of the light-diffusing member can be secured to be of a fixed value for every product without variation. Accordingly, variation in the luminance distribution for every product can be suppressed.

The open space 33 is formed between the partition plate 32 and the light-diffusing portion 34 according to the following reason.

If the open space 33 of the light-diffusing portion 34 is omitted and light-diffusive material is filled to form a solid part instead of the open space 33, the thickness of the light-diffusing portion 34 becomes too great to increase a degree of diffused light, which has been emitted from the LEDs 11 and is not radiated from an upper surface of the light-diffusing portion 34, too much.

As a result, luminance decreases so that the light looks gloomy, the light out of the light-diffusing portion 34 turns into dull yellow or the like in chromaticity, and visual lighting effect is reduced by half.

Figure 6:
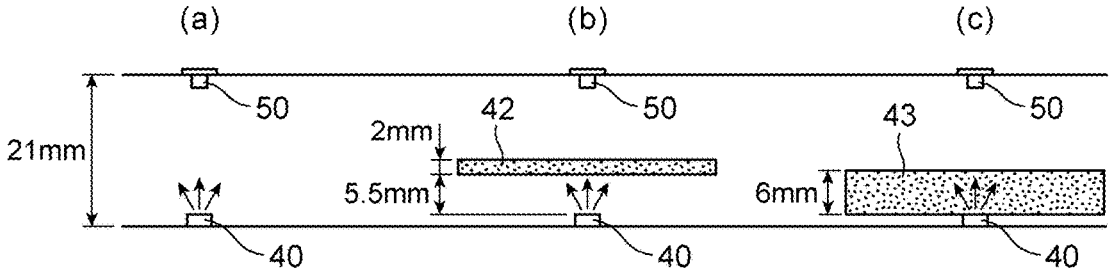
FIG. 6 is a view in measuring chromaticity in Embodiment 1 according to the present invention and a comparative example.

Results of actual measurement will now be discussed. FIG. 6 are views showing how elements are arranged when measuring a amount of attenuation of light and change of color-temperature, in a case where an open space is provided and the light-diffusing portion is arranged therein, and in another case where the open space is not provided, light-diffusive material is solidly filled instead of the open space.

Six LEDs of the SMD type are linearly arranged at intervals of 10 millimeters to form a light source, and the LEDs are turned on at 70 milli-Watts per one piece. A colorimeter with a light-shielding barrel No. 52001 (Yokogawa Meters & Instruments Corporation) is used as a chromaticity meter 50. As shown in FIG. 6A, the distance between an LED 40 and the chromaticity meter 50 is set up to 21 millimeters.

In the case where the open space is provided between the LED 40 and the a light-diffusing portion 42, as shown in FIG. 6B, on condition that air clearance is 5.5 millimeters and the thickness of the light-diffusing portion 42 is 2 millimeters, light out of the light-diffusing portion 42 becomes even and uniform.

In the other case where the open space is not provided and the light-diffusive material is filled instead thereof, as shown in FIG. 6C, on condition that the thickness of a light-diffusing portion 43 is 6 millimeters, light out of the light-diffusing portion 43 becomes even and uniform.

Figure 7:
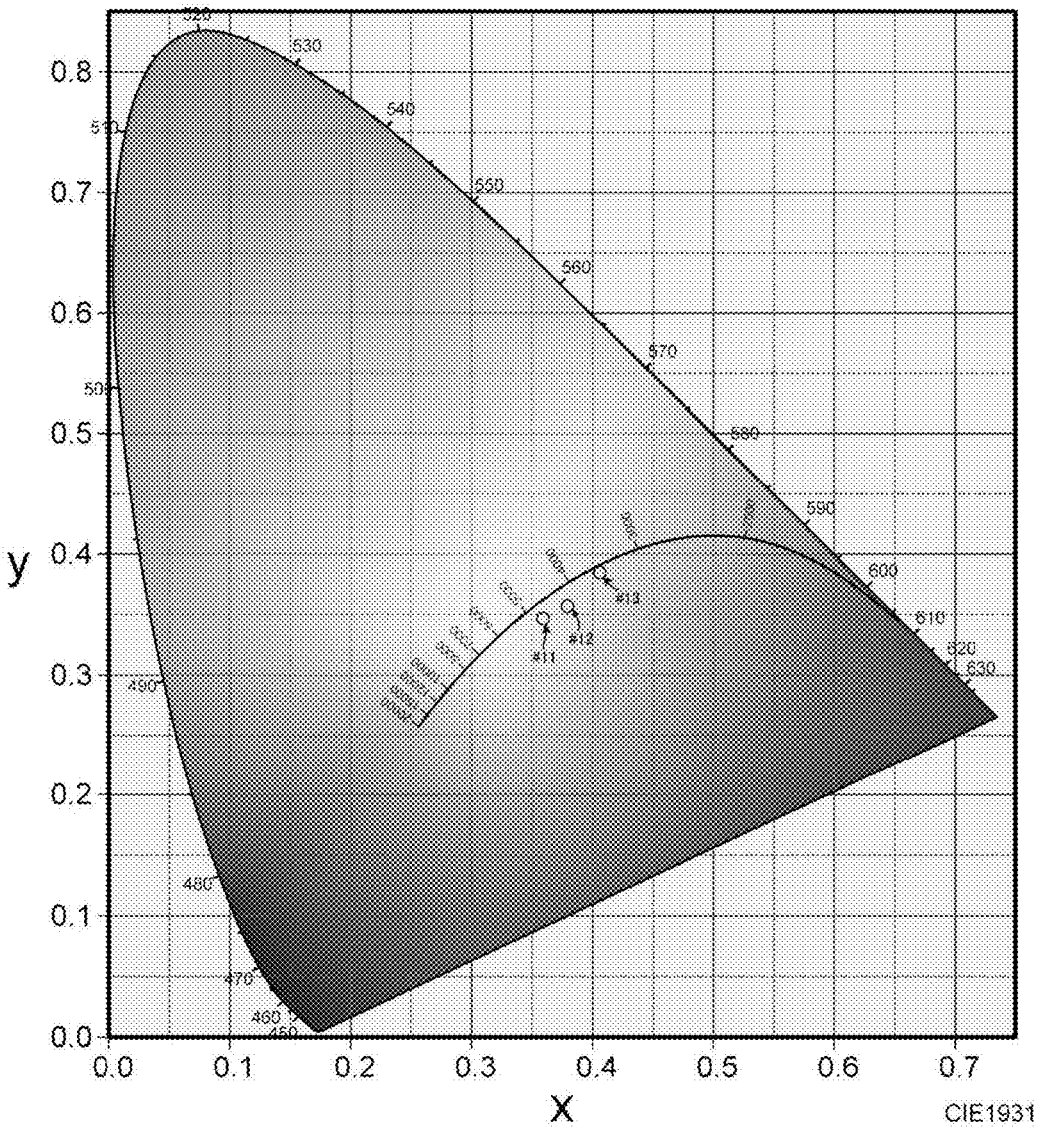
FIG. 7 is a graph illustrating chromaticity values of light out of the light-diffusing portion in Embodiment 1 according to the present invention and a comparative example.

Table 1 shows results in measurement of luminance and chromaticity in these cases. FIG. 7 is a chromaticity diagram on which chromaticity data are plotted in these cases.

As clear from FIG. 7, in a case of "#13" where the open space is not provided and the light-diffusing portion 43 is solid, color-temperature is remarkably shifted to a yellow side and light turns into dull yellow comparing with a case of "#12" where the open space is provided. In addition, it is apparent that luminance in the case of "#13" is reduced by half. Herein, a symbol of "#11" in FIG. 7 indicates chromaticity data in a case without a light-diffusing portion.

In view of the above results, in order to:

prevent a state where positions of the LED light sources appear in a dotted pattern to attain even and uniform light; and reduce color shift and attenuation of light, it is not effective to increase the thickness of the light-diffusive material.

On the contrary, the light-diffusive layer should be formed thin having a thickness of about two millimeters; and the light-diffusive layer should be arranged away from the LEDs at a distance of about five millimeters.

TABLE 1

| LD (light-diffusing) | (a) No LD portion | (b) space + LD portion | (c) LD portion only |
|---|---|---|---|
| x (chromaticity) | 0.3615 | 0.3793 | 0.4042 |
| y (chromaticity) | 0.3482 | 0.3556 | 0.3835 |
| L (luminance[cd/m$^2$]) | 23,440 | 7,361 | 3,203 |

As shown in FIG. 5A, in the other case where the open space is not provided between the partition plate 32 and the light-diffusing portion 34 and at least one of transparent synthetic resin and transparent rubber is filled instead thereof to form a transparent part, ultraviolet rays easily erode the transparent part resulting in failure that luminescent color of light turns into dull yellow or the like and attenuation of the light increases.

Hereinafter, a result of having measured chromaticity of light out of the light-diffusing portion will now be described when color of the transparent part turns into yellow.

Figure 8:
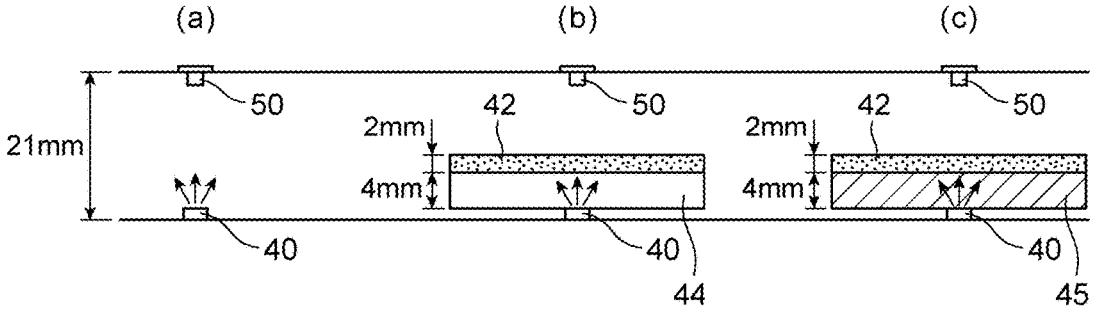
FIG. 8 is a view in measuring chromaticity in Embodiment 1 according to the present invention and a comparative example.

FIG. 8 illustrates an experiment method. One of the LED 40 of the SMD type is turned on at 45 milli-Watts as a light source.

FIG. 8A shows a case where luminescence light of the LED is directly measured. FIG. 8B shows a case where transparent vinyl chloride material 44 of 4 millimeters is used as filling material and further where the light-diffusing portion 42 of 2 millimeters is arranged on an upper side thereof. FIG. 8C shows a case where a substrate made of vinyl chloride material 45 having thickness of 4 millimeters is used instead of the transparent vinyl chloride material 44 in FIG. 8B. The vinyl chloride material 45 has been left for five years, and has turned into yellow.

Table 2 shows a result measured by the chromaticity meter 50. Since color of the solid transparent part has turned into yellow, luminance is reduced from 3,239 [cd/m$^2$] to 2,448 [cd/m$^2$], that is, 25% down.

Figure 9:
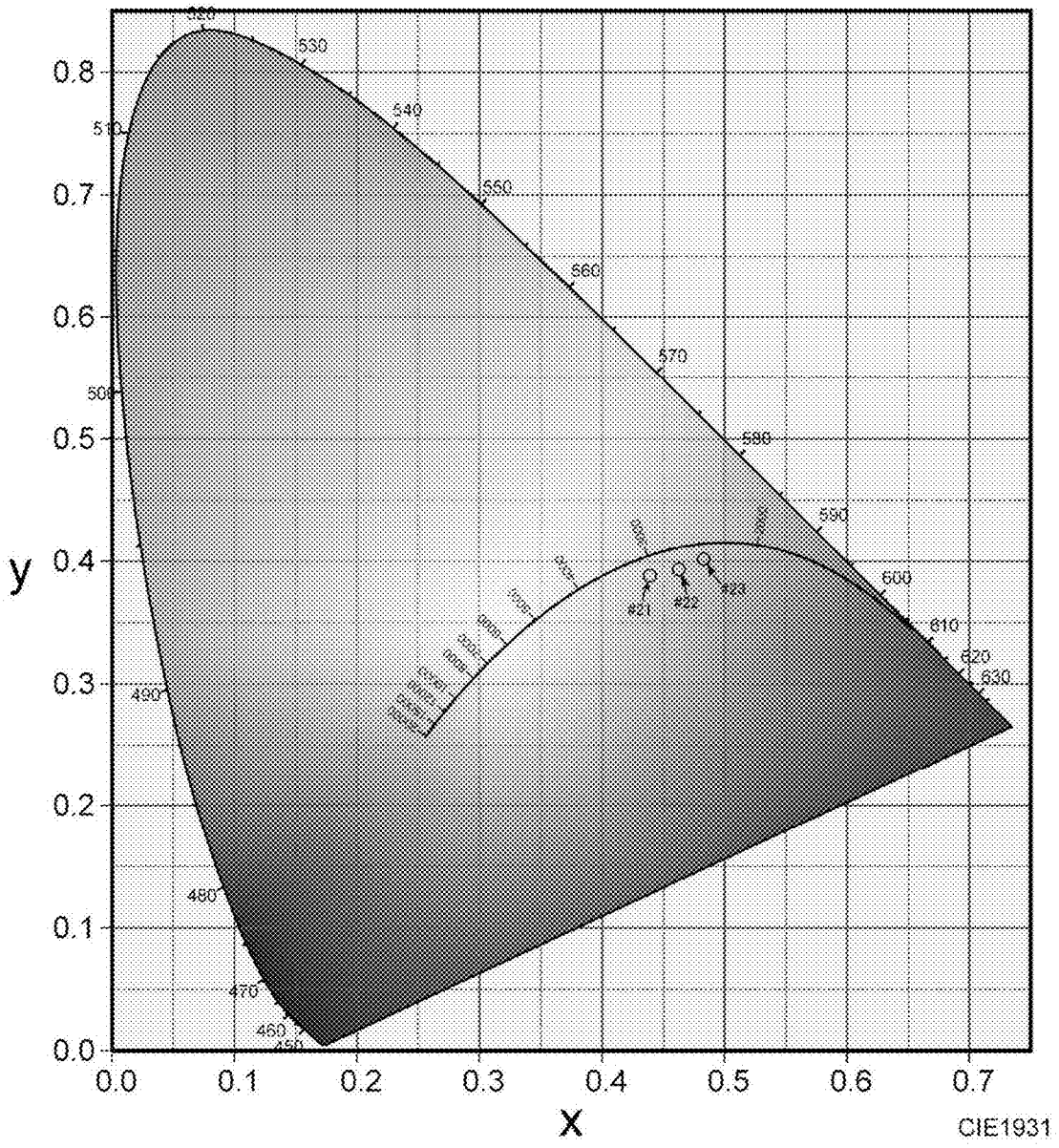
FIG. 9 is a graph illustrating chromaticity values of light out of the light-diffusing portion in Embodiment 1 according to the present invention and a comparative example.

FIG. 9 shows measured chromaticity values on a chromaticity diagram. A symbol of "#21" shows chromaticity in the case where the luminescence light of the LED is directly measured, a symbol of "#22" shows chromaticity in the case where the transparent vinyl chloride material 44 and the light-diffusing portion 42 are overlapped, and a symbol of "#23" shows chromaticity in the case where deteriorated vinyl chloride material 45 whose color has turned into yellow and the light-diffusing portion 42 are overlapped.

As shown in FIG. 9 using the symbols of "#22" and "#23", chromaticity moves to an orange side and light changes into dull color.

TABLE 2

| | (a) direct measuring | (b) transparent vinyl chloride | (c) deteriorated vinyl chloride |
|---|---|---|---|
| x (chromaticity) | 0.4415 | 0.4559 | 0.4751 |
| y (chromaticity) | 0.3832 | 0.3896 | 0.4009 |
| L (luminance[cd/m$^2$]) | 11,510 | 3,239 | 2,448 |

In order to solve such a subject-matter, the open space 33 is provided between the partition plate 32 and the light-diffusing portion 34.

When the partition plate 32 is made of light-diffusive material containing light-diffusive agent, the partition plate 32 diffuses light to decrease luminance of light reaching the front face of the light-diffusing portion 34, thereby the partition plate 32 looks darker.

This is because the partition substrate 32 of the belt-like insulating case 30 is formed with light transmissibility.

Even if the partition substrate is made of at least one of transparent synthetic resin and transparent synthetic rubber, light cannot transmit through it at a rate of 100%.

When the thickness of the partition plate 32 becomes greater, luminance slightly decreases and chromaticity of light also slightly turn from white into yellow. Accordingly, it is preferable to set up the thickness of the partition plate 32 within one to two millimeters.

In the other case where the open space is not provided between the partition plate and the light-diffusing portion, and further where transparent synthetic resin and light-diffusive material are filled instead thereof, the entire weight becomes heavier by 20 to 30 percent.

Since this belt-like product is used for lighting a ceiling and a wall of a building, the product should be as lighter as possible.

In a case of lighting the ceiling, a jig including a groove whose width is fitted to the product is installed on the ceiling first, and then the product is inserted into the groove to be fixed.

The heavy entire weight may cause failure that the product comes off the groove to hang down. The worst is that the product falls down. In view of the above, a part between the partition plate and the light-diffusive material should preferably be hollow.

As mentioned above, FIG. 2 and FIG. 3 are sectional views showing forming examples incorporating insulating case and the light-diffusing portion in Embodiment 1 according to the present invention.

Figure 2:
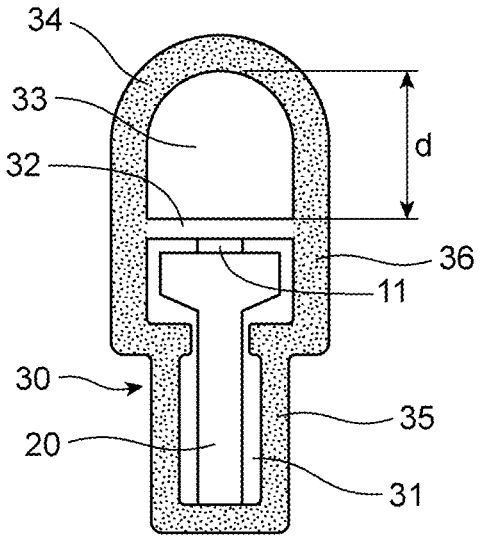
FIG. 2 is a sectional view in an example of integrally forming an insulating case and a light-diffusing portion in Embodiment 1 according to the present invention.

In an example of FIG. 2, only the partition plate 32 has light-transmissibility, and the belt-like insulating cases 30 and the light-diffusing portion 34 are made of the light-diffusive material.

In this example, light emitted from the LEDs 11 comes out from the light-diffusing portion 34. Furthermore, a part of diffused light also comes out from a side section 36. That is, diffused light comes out from almost all of the belt-like insulating case 30.

In an example of FIG. 3, the partition plate 32 and a lower part 35 of the belt-like insulating case 30 have light-transmissibility, and an upper part of the belt-like insulating case 30 and the light-diffusing portion 34 are made of the light-diffusive material.

In the example of FIG. 3, since light from the LEDs 11 naturally does not reach the lower part 35 of the belt-like insulating case 30, the lower part need not to have light-transmissibility.

Where should be made of the light-diffusive material may change according to a place where the belt-like LED light is used. Cases other than FIG. 2 and FIG. 3 may be considered. Two-color molding enables forming members as we wish also in such cases.

Next, FIG. 10 to FIG. 13 show Embodiment of a circuit substrate for mounting LEDs thereon to constitute the LED unit 20. The LED unit 20 is inserted into the space 31 of the belt-like insulating case 30 shown in FIG. 2 and FIG. 3. The circuit substrate in the Embodiment is the same as recited in Reference 6.

Figure 10A:
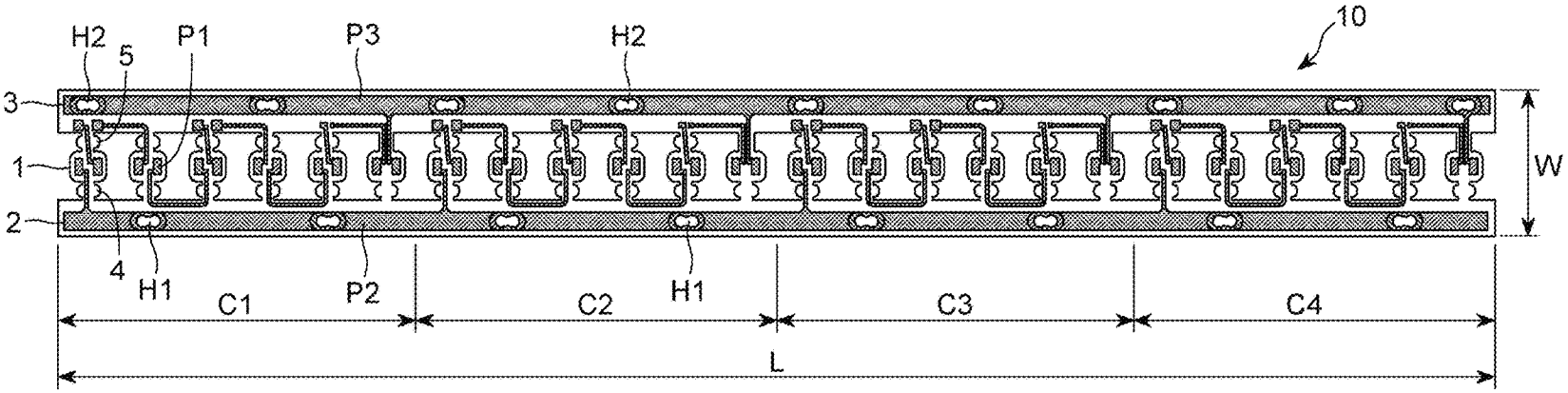
FIG. 10A is a plan view of a whole unit of an LED-mounting circuit substrate in Embodiment 1 according to the present invention.
Figure 10B:
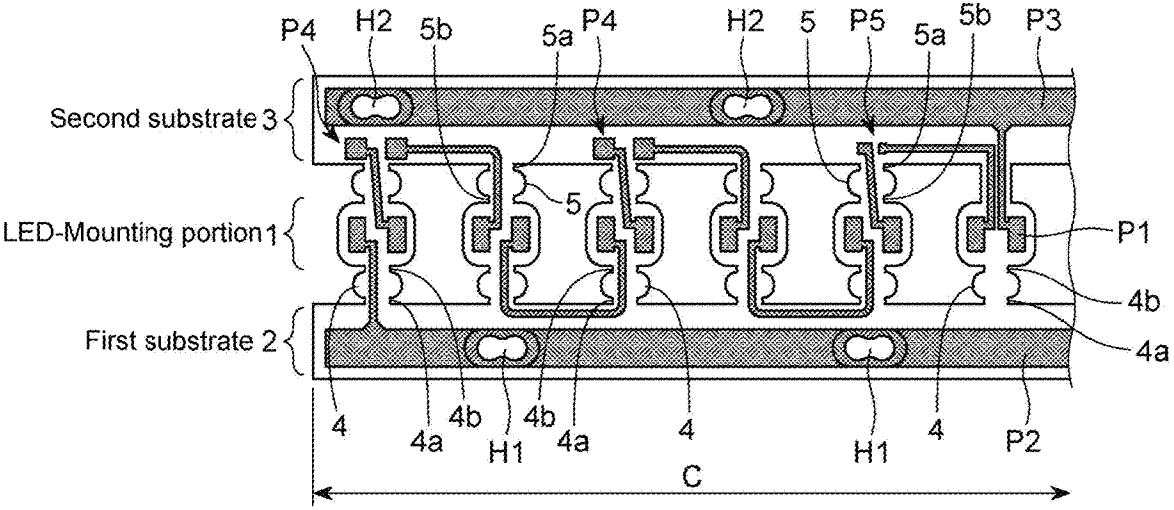
FIG. 10B is an expanded plan view of one circuit of the same.

FIG. 10(*a*) is a plan of all of one unit, and FIG. 10B is an expanded plan of the one circuit. As shown in FIG. 10A and FIG. 10B, hereinafter a LED-mounting circuit substrate in this Embodiment may be simply called as a "circuit substrate."

A circuit substrate 10 is configured as follows. An LED mounting portion 1 is formed at a center part in a width direction of a long, flexible, and belt-like substrate. And, a plurality of LEDs are mounted in an array state on the LED mounting portion 1.

In both sides of the LED mounting portion 1 in the width direction, a first substrate 2 and a second substrate 3 are provided. On the first substrate 2 and the second substrate 3, power supply patterns for supplying current to the plurality of LEDs are formed.

The LED mounting portion 1, the first substrate 2, and the second substrate 3 are formed foldably with each other.

In this Embodiment, the LED mounting portion 1 and the first substrate 2 are connected with a connecting piece 4 having cut sections 4*a* and 4*b* at both ends thereof. The LED mounting portion 1 and the second substrate 3 are connected with a connecting piece 5 having cut sections 5*a* and 5*b* at both ends thereof.

Since it is difficult to narrow a width of a part of the connecting piece 5 in order to pass one or more pairs of power supply patterns, forming the cut sections 5*a* and 5*b* may be omitted in some cases.

Both ends in the width direction of the flexible substrate are connected to the first substrate 2 and the second substrate 3 using the connecting pieces. Independent and island-like LED mounting portions are formed at intervals on the flexible substrate to constitute the LED mounting portion 1.

Upon folding the first substrate 2 and the second substrate 3 against the LED mounting portion 1, and overlapping rear faces of the first substrate 2 and the second substrates 3 (See, FIG. 12E.), the island-like LED mounting portions are positioned independently, thereby forming spaces between the plurality of island-like LED mounting portions to be separated.

Due to this, in a step of bending the first substrate 2 and the second substrates 3 perpendicular to a surface of the LED mounting portion 1, and also in another step of bending upper portions of the first substrate 2 and the second substrates 3 perpendicular to the remainder portions of the same, the LED mounting portion suffers only slight stress and the bending steps can be easily performed.

An LED land P1 of a power supply pattern is formed on the LED mounting portion 1. An LED of a surface mounting type is to be mounted on the LED land P1. A power supply pattern P2 for impressing positive voltage from a DC power source is formed on the first substrate 2. And, a ground pattern P3 to be connected to ground of the DC power source is formed on the second substrate 3.

At the power supply pattern P2 and the ground pattern P3, through holes H1 and H2 are opened. On the opposite surfaces of the patterns P2 and P3, external electric wires are connected to the through holes H1 and H2 by soldering.

Figure 11:
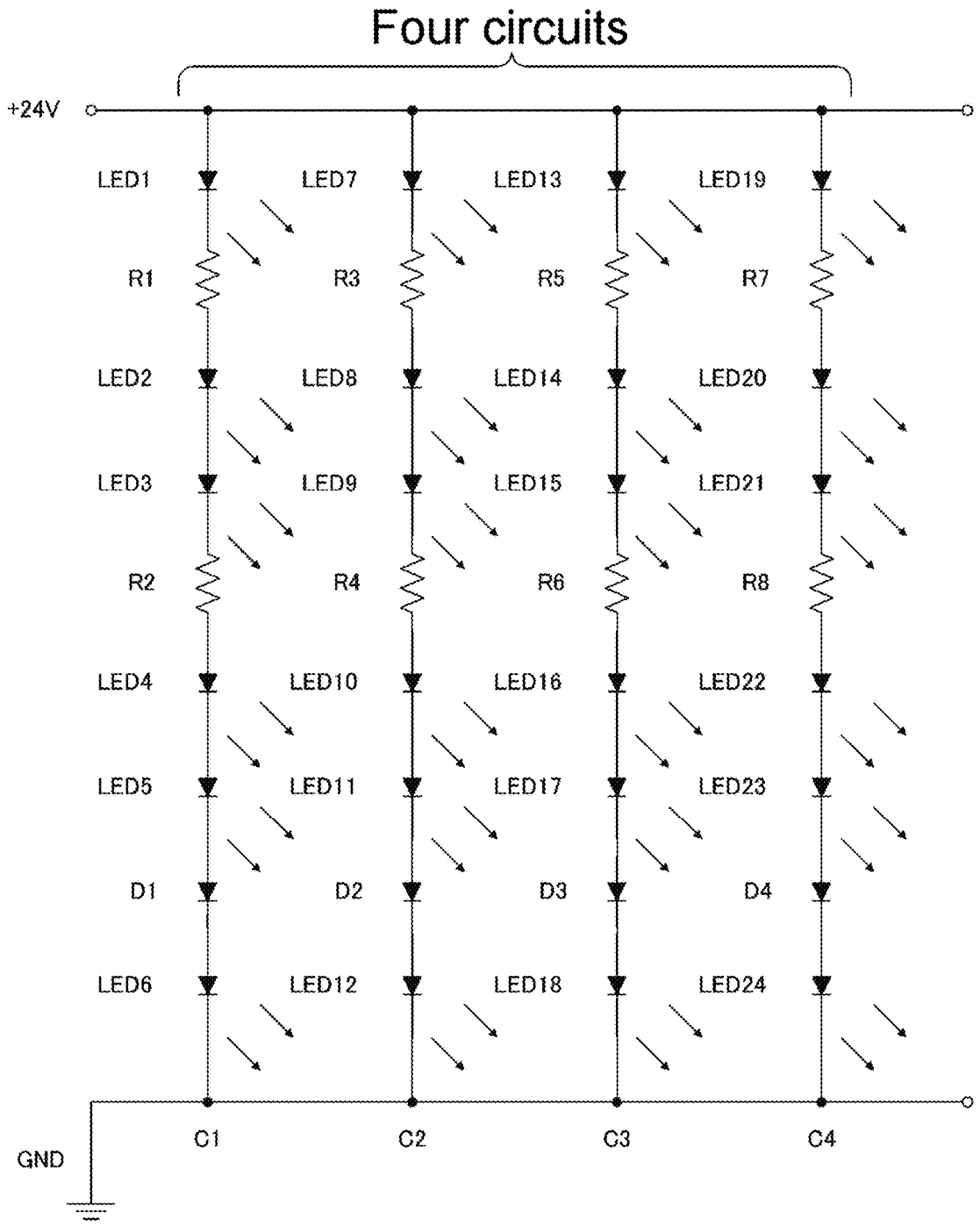
FIG. 11 is a diagram illustrating a state of wiring LEDs and electrical parts to be mounted on the circuit substrate in Embodiment 1 according to the present invention.

In addition to the ground pattern P3, a resistance land P4 and a diode land P5 are formed on the second substrate 3. In one unit of the circuit substrate 10, four circuits C1 to C4 each having the same construction are formed. The construction is configured including LED-1 to LED-24, resistances R1 to R8, and reverse-flow blocking diodes D1 to D4 as shown in FIG. 11.

In Embodiment 1, the one unit of the circuit substrate 10 has length L of 240 millimeters, width of 24 millimeters, substrate thickness of 100 micrometers, and copper foil (conductive pattern) having thickness of 35 to 50 micrometers. The scope of the present invention is never limited to these values.

FIG. 10(*a*) shows a case where the four circuits form one unit. In order to realize a linear light source whose length attains one or more meters, however, power supply patterns P2 and ground patterns P3 of a lot of units are preferably connected in parallel with external electric wires, thereby forming a lighting system having desired length.

FIG. 12 shows:

a step of mounting the LED 11 of the surface mounting type, electrical parts 12 (in this example, a resistance, and a diode) on the circuit substrate 10;

a step of soldering electric wires 13 and 14 on the power supply pattern P2 and the grand pattern P3; and a step of forming the soldered circuit substrate into a light-emitting unit U having a T-shaped cross-section.

FIG. 12A is a plan view, and FIG. 12B to FIG. 12E are front and sectional views.

FIG. 12B shows a state where the circuit substrate 10 has not been bent yet. From this state, as shown in FIG. 12C, using the cut sections 4*b* and 5*b* as bending portions, the cut sections 4*b* and 5*b* are downward bent in 90 degrees.

As shown in FIG. 12D, while keeping the first substrate 2 and the second substrate downward in parallel, the cut sections 4*a* and 5*a* are further bent.

Finally, as shown in FIG. 12E, rear faces of the connecting pieces 4 and 5 contacts with a rear face of the LED mounting portion 1, and rear faces of the first substrate 2 and the second substrate 3 also contact with each other. The contacting rear faces are united with adhesive to form the light-emitting unit U having the T-shaped cross section.

The light-emitting unit U can be freely bent as a whole in a direction perpendicular to faces of both of the first substrate 2 and the second substrate 3. This is because the rear faces of the first substrate 2 and the second substrate 3 are united to be one flexible plate, and the upper LED mounting portion 1 forming the T-shaped cross section is separated from an adjacent LED mounting portion 1.

Figure 13B:
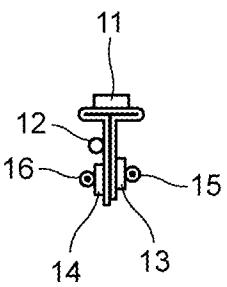
FIG. 13B is a front sectional view.
Figure 13A:
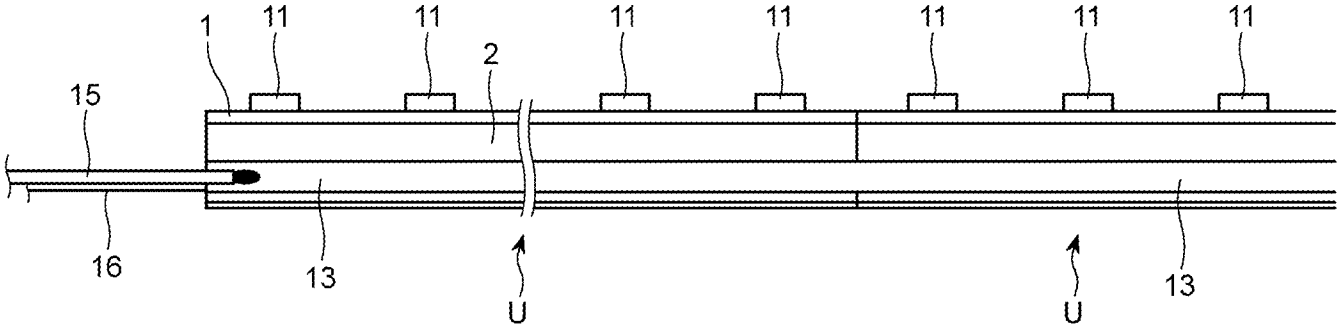
FIG. 13A is a side view of a light-emitting unit U in Embodiment 1 according to the present invention.
Figure 13C:
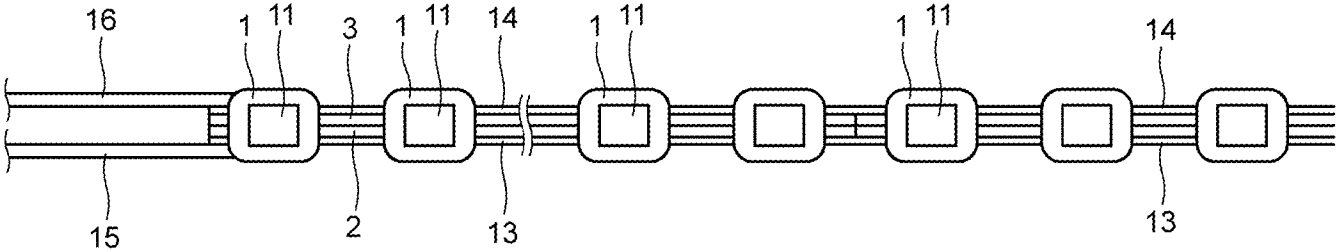
FIG. 13C is a plan of the same.

FIG. 13A is a side view of the light-emitting unit U, FIG. 13B is a front view thereof, and FIG. 13C is a plan view thereof.

As shown in the Figs., a plurality of light-emitting units U are connected in parallel with the electric wires 13 and 14 that supply power. The power-source cables 15 and 16 are connected to ends of the electric wires 13 and 14 of a first light-emitting unit U by soldering. As the electric wires 13 and 14, such as copper plates, single lines, stranded lines, and mesh wires, that can pass current greater than power supply patterns of conductive foils on the first substrate 2 and the second substrate 3 are used.

The outside of the plurality of light-emitting units U having been linearly connected with each other may be sealed with light-transmissible silicone rubber to make the LED unit 20 of the T-shaped cross section. The made LED unit 20 may be inserted from an opening of the belt-like insulating case 30 as shown in FIG. 2 and FIG. 3 into the space 31 of an almost T-shape cross section to form a belt-like LED light.

Alternatively, without sealing with the light-transmissible silicone rubber, the plurality of light-emitting units U having been linearly connected may be inserted from the opening of the belt-like insulating case 30 as shown in FIG. 2 and FIG. 3 into the space 31 of the almost T-shape cross section. Herein, the space 31 is formed so as to insert the units U in a manner such that upper faces of the LEDs 11 slide along a lower surface of the partition plate 32.

Since the lower surface of the partition plate 32 and the upper faces of the LEDs 11 are positioned to contact with each other, the distance from the LEDs 11 to a lower surface of the light-diffusing portion 34 is secured to have a fixed value without variation for every product. As a result, variation in luminance distribution for every product can be suppressed.

After that, an air gap between the space 31 and the LED units U is filled with the silicone rubber from openings at the ends of the belt-like insulating case 30 to a place where can secure sealing property, thereby the air gap is substantially sealed.

Since a part of the length of the belt-like insulating case 30 may not be sealed to reduce consumption volume of the silicone rubber. Furthermore, the sealing property of the belt-like LED light can also be maintained.

In the above, silicone rubber has been used for the sealing. Synthetic resin for sealing, such as commercially available epoxy resin or the like may be used instead. And, light-transmissible material has been used. Alternatively, not light-transmissible material may be used.

The LED mounting substrate illustrated in FIG. 10 to FIG. 13 is a mere example. The LED unit 20 applied to the belt-like LED light according to the present invention is not limited to this.

Figure 14:
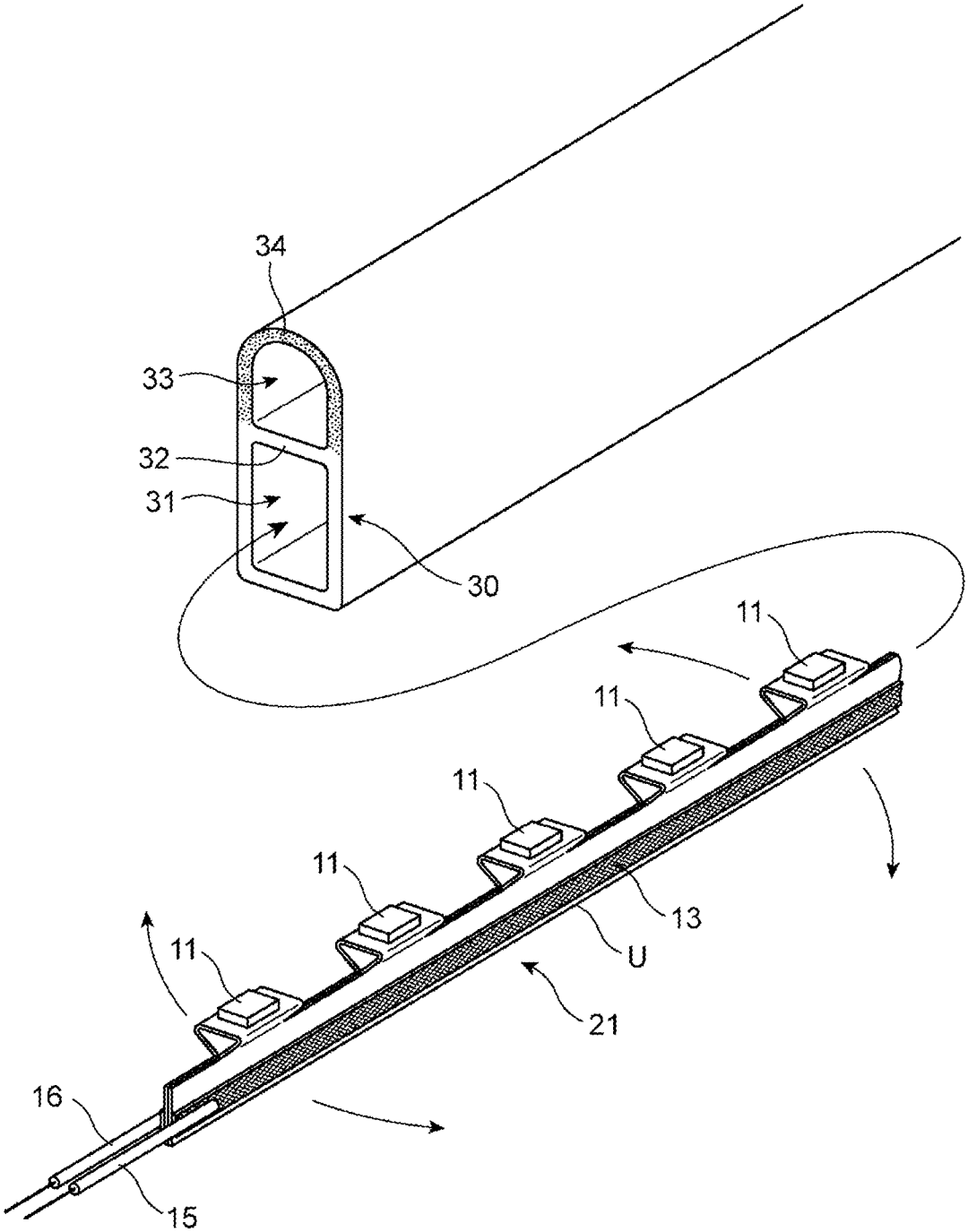
FIG. 14 is a decomposition perspective diagram in Embodiment 2 according to the present invention.

FIG. 14 shows an LED unit 21 in Embodiment 2 according to the present invention.

As mentioned above, the LED unit 20 in Embodiment 1 relates to an example that the sealing transparent silicone rubber surrounds the light-emitting unit U in FIG. 13.

In Embodiment 2, the LED unit 21 includes a plurality of light-emitting units U having been linearly connected with each other.

Figure 12:
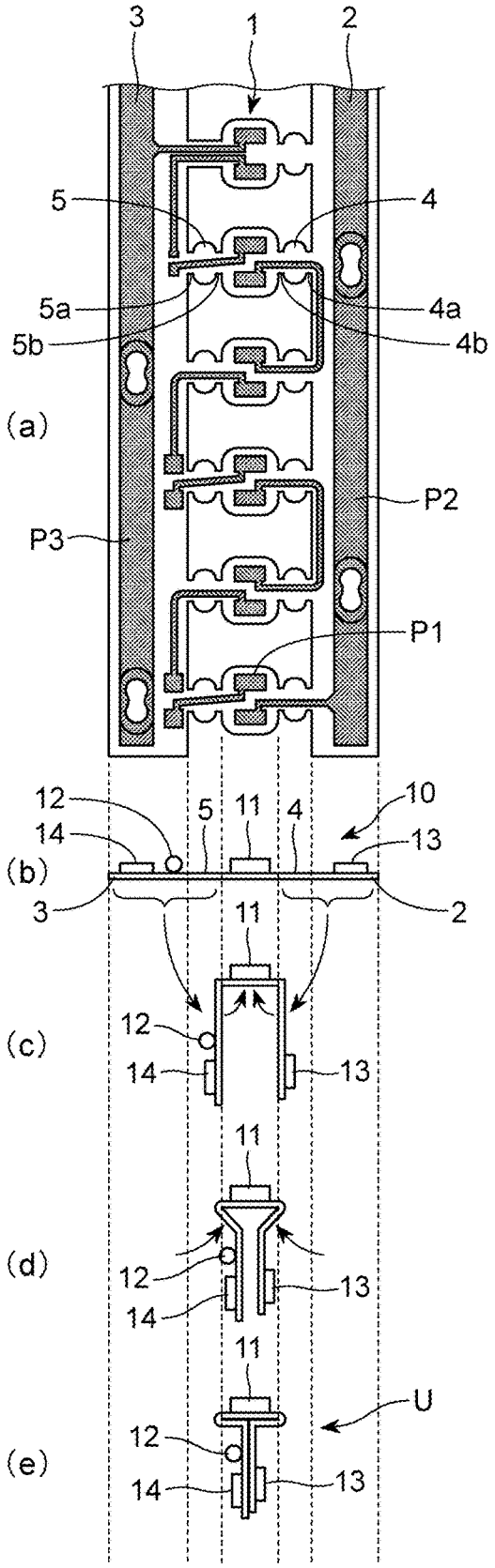
FIG. 12 is a view illustrating a step of mounting LEDs and electrical parts on the circuit substrate and other steps of assembling the circuit substrate into a light-emitting unit of a T-shaped cross-section in Embodiment 1 according to the present invention, (a) being a plan view and (b) to (e) being front sectional views of the same.

Referring now to FIG. 12 or the like, rear faces of the first substrate 2 and the second substrate 3 are adhered with each other. However, rear faces of the LED mounting portion 1 and the connecting pieces 4 and 5 may not be adhered.

In Embodiment 2, the LED unit 21 is inserted into the space 31 of the belt-like insulating case 30, and then the space 31 is filled with the transparent silicone rubber, thereby forming a flexible belt-like LED light. Since structures and effects other than the above are the same as Embodiment 1, explanation thereof is omitted.

Each of Embodiment 1 and Embodiment 2 according to the present invention enables to provide a belt-like LED light that attenuation of light is less and that can radiate even and uniform light of almost white.

The LED units 20 and 21 can be bent in the lateral direction against the light-emitting direction of the LED 11, and the belt-like insulating case 30 is made of flexible material. Accordingly, the belt-like LED light itself has flexible structure.

The partition plate 32 and the light-diffusing portion 34 are formed by two-color molding. Material whose optical characteristics differ from each other can be integrally formed.

The air gap between the LED units 20 and 21 and the space of the belt-like insulating case 30 is filled with the synthetic resin or synthetic rubber for sealing. Accordingly, the belt-like LED light itself has moisture-proof and waterproof configuration, and is also suitably used on the outdoors.

The belt-like LED light according to the present invention can radiate even and uniform light which is near to light of white originally emitted by LED light source and whose attenuation is less. Accordingly, the belt-like LED light is suitably used as a various kinds of indoor lighting system, outdoors decorative illumination system, or the like, for example.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

DESCRIPTION OF SYMBOLS

1: LED-Mounting Portion
2: First Substrate
3: Second Substrate
4: Connecting Piece
4*a* and 4*b*: Cut section
5: Connecting Piece
5*a* and 5*b*: Cut section
10: LED-Mounting Substrate (Circuit Substrate)
11: LED
12: Electrical Part (Resistance, Diode)
13 and 14: Electric wire
15 and 16: Power-source cable
20 and 21: LED unit
30: Belt-like Insulating Case
31: Space
32: Partition Plate
33: Open Space
34: Light-diffusing Portion
40: LED
42 and 43: Light-diffusing Portion
44: Vinyl Chloride Material
45: Deteriorated Vinyl Chloride Material
50: Chromaticity Meter

What is claimed is:

1. A belt-like LED light, comprising:

an LED unit including a plurality of LEDs being linearly arranged at predetermined intervals, the plurality of LEDs emitting light in a light-emitting direction;

a belt-like insulating case including a space and a partition plate, said LED unit being inserted into the space, the partition plate being made of light-transmissible material, at least a part of the light transmitting through the partition plate; and a light-diffusing portion continuously installed outside of said belt-like insulating case, said light-diffusing portion including an open space and an arcuate curved section located adjacent to the open space, the curved section being made of light-diffusive material and diffusing the light having transmitted through the partition plate and the open space, said curved section having a semicircular cross-section, the plurality of LEDs being connected with a plurality of electric wires, said LED unit being formed capable of being bent in a lateral direction against the light-emitting direction, said belt-like insulating case and said light-diffusing portion being integrally formed by two-color molding without a seam therebetween, said belt-like insulating case and said light-diffusing portion being made of a flexible material, an air gap existing between the space of said belt-like insulating case and said LED unit inserted into the space, the air gap being filled with at least one of synthetic resin and synthetic rubber.

2. The belt-like LED light as set forth in claim 1, wherein the relative light intensity characteristics in a width-wise direction of the LED are shown with almost circular contour lines contacting with a light-emitting surface of the LED, said light-diffusing portion having a curvature and a position set up such that a lower surface of the light-diffusing portion inscribes with one of contour lines.

* * * * *